US005647453A

United States Patent [19]

Cassells

[11] Patent Number: 5,647,453

[45] Date of Patent: Jul. 15, 1997

[54] MULTI-PURPOSE LADDER APRON

[76] Inventor: Kevin J. Cassells, 3716 W. Chester Pike, Newtown Square, Pa. 19073

[21] Appl. No.: 373,558

[22] Filed: Jan. 17, 1995

[51] Int. Cl.[6] ..... B65D 85/00

[52] U.S. Cl. ..... 182/129; 248/238

[58] Field of Search ..... 182/129; 248/97, 248/238, 210; 206/373

[56] References Cited

U.S. PATENT DOCUMENTS

| | | | |
|---|---|---|---|
| D. 317,206 | 5/1991 | Cagle | D25/68 |
| 4,356,854 | 11/1982 | McGee | 182/129 |
| 5,123,620 | 6/1992 | Bourne | 248/210 |
| 5,181,682 | 1/1993 | Indelicato | 248/210 |
| 5,191,954 | 3/1993 | Ledford | 182/129 |
| 5,342,008 | 8/1994 | Kay | 248/238 |

*Primary Examiner*—Alvin C. Chin-Shue
*Attorney, Agent, or Firm*—Famiglio & Massinger

[57] ABSTRACT

A multi-purpose ladder utility apron comprised of four side panels, each adapted with a plurality of tool and accessory receptacles and further comprised of a fold up storage tray on the ladder's top providing additional temporary storage space. Closure flaps and straps secure the apron to the ladder whether in its open or closed position such that the subject invention may be secured to the ladder during use, transport and storage and may be quickly removed for laundering. An optional lid is also pivotally attached to the apron and folds out to provide a work shelf. The apron's design accommodates use of the ladder's own fold-down shelf and permits use of all steps without sacrificing storage space for tools and the like. The apron may further be adapted with a power receptacle so that power tools can easily be interchanged without disengaging the extension cord.

6 Claims, 5 Drawing Sheets

MULTI-PURPOSE LADDER APRON

FIELD OF THE INVENTION

The subject invention relates generally to a peripheral device for ladders, and to a multi-purpose utility apron for stepladders, in particular.

BACKGROUND OF THE INVENTION

Persons who employ ladders in their work routine often experience problems such as having insufficient work space, having to make repeated trips up and down the ladder to retrieve needed tools, and having plug connections for power tools and the like becoming disengaged. Heretofore, a variety of ladder peripheral devices have been designed and employed in an attempt to solve at least some of these problems associated with ladder usage.

U.S. Pat. No. 5,342,008 issued to Kay on Aug. 30, 1994, is one recent example of an attempt to provide increased work space at the top of a step ladder. The Kay reference teaches a large, rigid panel or platform attached to the stepladder by means of channels which, in turn, are connected to brackets. While the invention of Kay may be useful for some type stepladders, and even rung ladders, it is not seemingly adaptable to the most common stepladders having an A-frame configuration and terminating at the top with a small rectangular step surface. Instead, the stepladders to which Kay is directed are those having a hand rest extending beyond the top of the last step.

A similar invention can be observed in the teachings of U.S. Pat. No. 5,191,954 issued Mar. 9, 1993, to Ledford. Here, a ladder platform and utility frame means is formed by a foot plate supported by adjacent ladder rungs and an open frame mounted on an elongated rod entering the lowermost ladder rung supporting the foot plate. The Ledford reference also accomplishes additional work space for rung ladders, but is not seemingly adaptable to conventional stepladders. Moreover, the invention of Ledford has many parts to achieve the intended result and, thus, is much more complicated than the subject invention described below.

One earlier reference, U.S. Pat. No. 5,123,620 issued Jun. 23, 1992 to Bourne, discloses an accessory container which is designed to be mounted over the top platform of a stepladder. The container includes a forward compartment defined by four walls and a bottom and is open at the top to provide storage space for holding tools, equipment and other work supplies that are needed by the worker when he or she is using the stepladder to perform construction or maintenance chores. The Bourne container was an excellent advancement in providing additional work space at the top of a stepladder, but also suffered from some significant shortcomings, namely it was not intended to remain permanently secured to the ladder, but had to be removed and replaced on an as needed basis, and its rigid, open container construction did not lend itself to tool organization. It was more like a storage bucket where tools and the like would be tossed in together making it more difficult to easily access the tool needed at any particular time.

In May of 1991, prior to the teachings of Bourne, Design Patent No. 317,206 was issued to Cagle which had the opposite problem. The invention of Cagle disclosed a tool holder for stepladders which took the form of a bag draped over the top of the ladder's top platform. The bag was secured with hook and loop straps and had, on one side, two pouch-like compartments for the storage of tools. The pouches were generally like those found on a worker's utility belt, such that tools could be snugly inserted and more easily organized. The Cagle design, however, completely ignored the need for an increased working area and was considered to be too small to offer significant advantage to the user. Moreover, it did not lend itself to remaining securely attached to the ladder when the ladder was in the closed position for transport.

Another shortcoming of prior art ladder peripherals is their failure to address the problem of falling extension cords which occurs when the power tool cord accidentally disengages from the extension cord. Many outdoor extension cords are constructed of thick, heavy insulated coatings. When attached to a power tool cord, the increasing force exerted on the connection as the tool is carried up the ladder causes separation of the plug from the socket and the extension cord falls to the ground. The worker then has the burden of climbing back down to retrieve the cord which has likely become tangled in the bushes below. Even if the cords do not become disconnected, the worker must support not only the weight of the tool itself, but of the attached extension cord leading to fatigue. Many workers attempt to prevent the occupance of fallen cords or the necessity of supporting the cord's additional weight by tying the extension cord to the top of the ladder. Such a practice can create a dangerous hazard and is not a foolproof solution to the problems sought to be resolved.

The subject invention obviates those shortcomings of the prior art by providing a multi-purpose ladder apron capable of holding a variety of different tools, parts and other accessories securely and in an organized fashion while simultaneously providing one or more additional working surfaces at the top of the ladder as well as a means for plugging in one or more power tools.

SUMMARY OF THE INVENTION

The subject invention more specifically is comprised of an apron having a rectangular frame member adapted to fit around the perimeter of the ladder's top step or platform. Four trapezoid shaped flaps are fixedly attached to the frame member; one flap per side, such that each flap hangs from the frame and are secured to the front, back and sides of the ladder when in its open or closed position. Each flap is adapted with various tool holders and accessory pouches for organization of and easy access to tools and supplies. For those who use the top step of the stepladder as a shelf for tools and supplies, a retaining wall has been pivotally attached to each side of the rectangular frame member and fold up together to form a tray. An optional lid may also be adapted to the frame member whereby the lid pivots open to provide additional work space at the top of the ladder. The apron may further be adapted with a power receptacle so that power tools can easily be interchanged without disengaging the extension cord.

It is therefore a primary object of the present invention to provide a multi-purpose ladder apron capable of holding tools and other accessories in an organized fashion while providing additional work space at the top of the ladder.

It is also a primary object of the present invention to provide a multi-purpose ladder apron having means for plugging in one or more power tools, simultaneously, without the risk of dropping or otherwise disconnecting the extension cord.

Another object of the subject invention is to provide a ladder utility apron that is constructed to securely and snugly fit on the ladder's top whether the ladder is in the open position for use or in the closed position for transport and storage. The subject utility apron may, therefore, be permanently attached to the ladder if so desired without the threat of it falling off during transport and without the threat of the tools which it holds from becoming dislodged.

Still another object of the subject invention is to provide a ladder utility apron that is highly compact when closed so as to facilitate both transport and storage of the ladder.

Other objects and advantages of the present invention will be apparent upon reference to the accompanying description when taken in conjunction with the following drawings in which similar reference numerals or characters designate similar parts.

DETAILED DESCRIPTION OF THE PREFERRED EMBODIMENT

Figure 1:
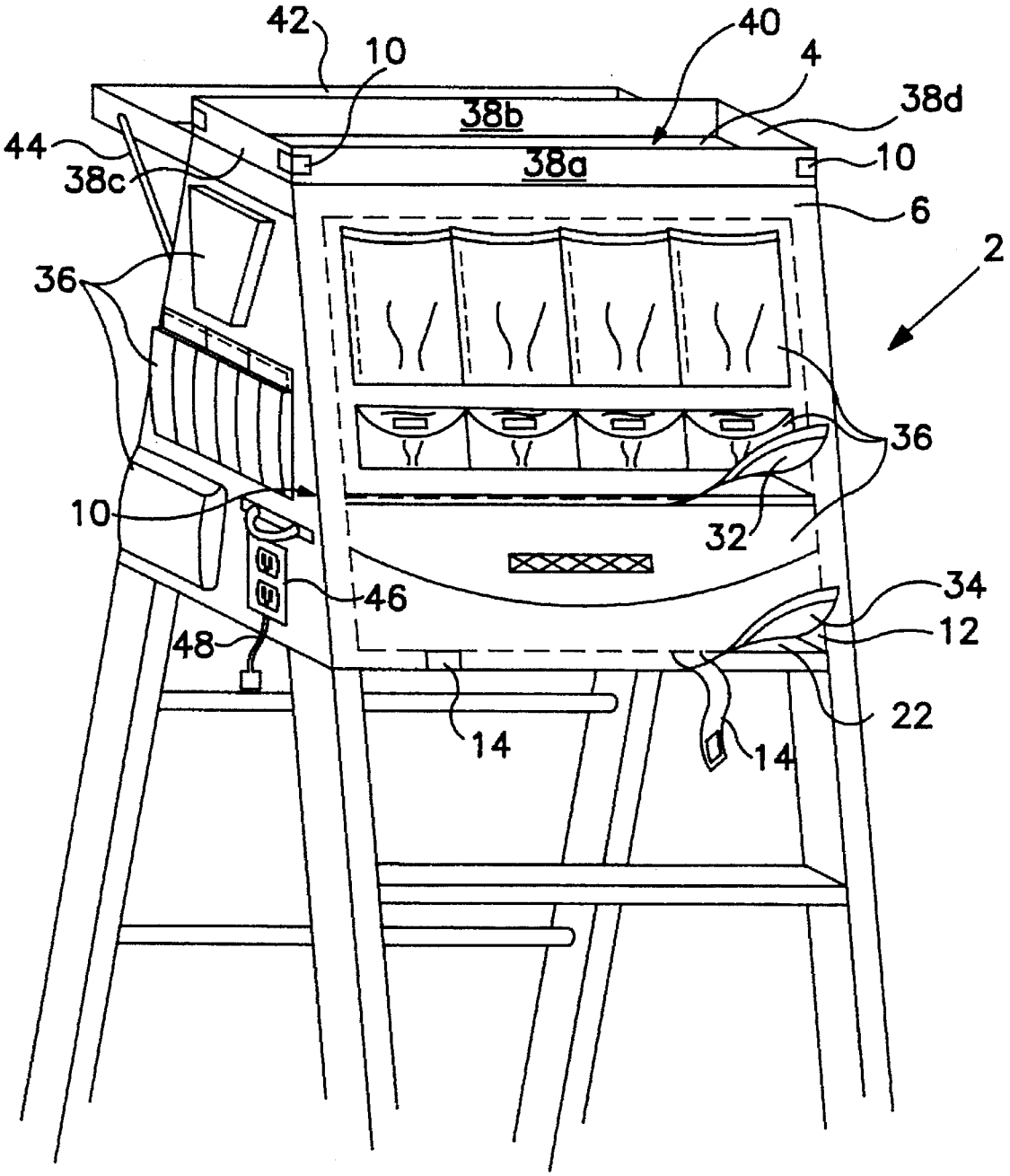
FIG. 1 is a perspective view of the subject multi-purpose ladder utility apron attached to a stepladder wherein the retaining walls are depicted in the folded-up position to provide a receptacle for tools and accessories on the ladder's top step.

Reference is now made to FIG. 1 in which there is depicted a perspective view of the preferred embodiment of the subject multi-purpose ladder utility apron, designated generally by reference numeral 2. A rectangular central panel 4 is situate on top of a ladder's top step or platform, said ladder shown in broken line for illustrative purposes only and forming no part of the claimed invention. A frame member 6, may optionally be attached about the perimeter of panel 4 to fit snugly about the side walls of the ladder's top step thereby providing a secure, non-slidable cap-like structure to which the remaining major components of the subject invention may be attached.

Figure 2:
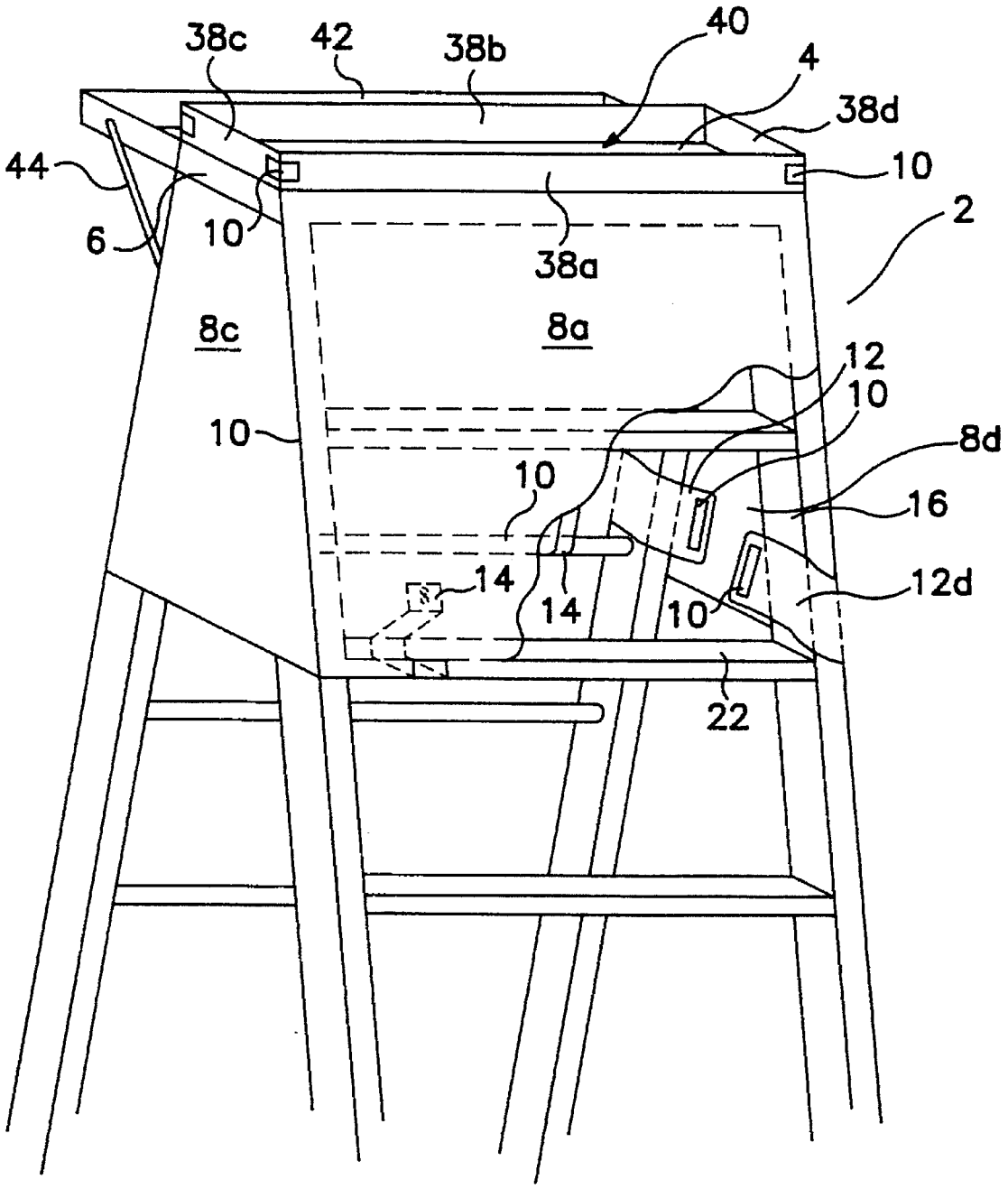
FIG. 2 is a perspective view of the invention of FIG. 1, absent tool and accessory receptacles to better illustrate the construction of the underlying shell.
Figure 3:
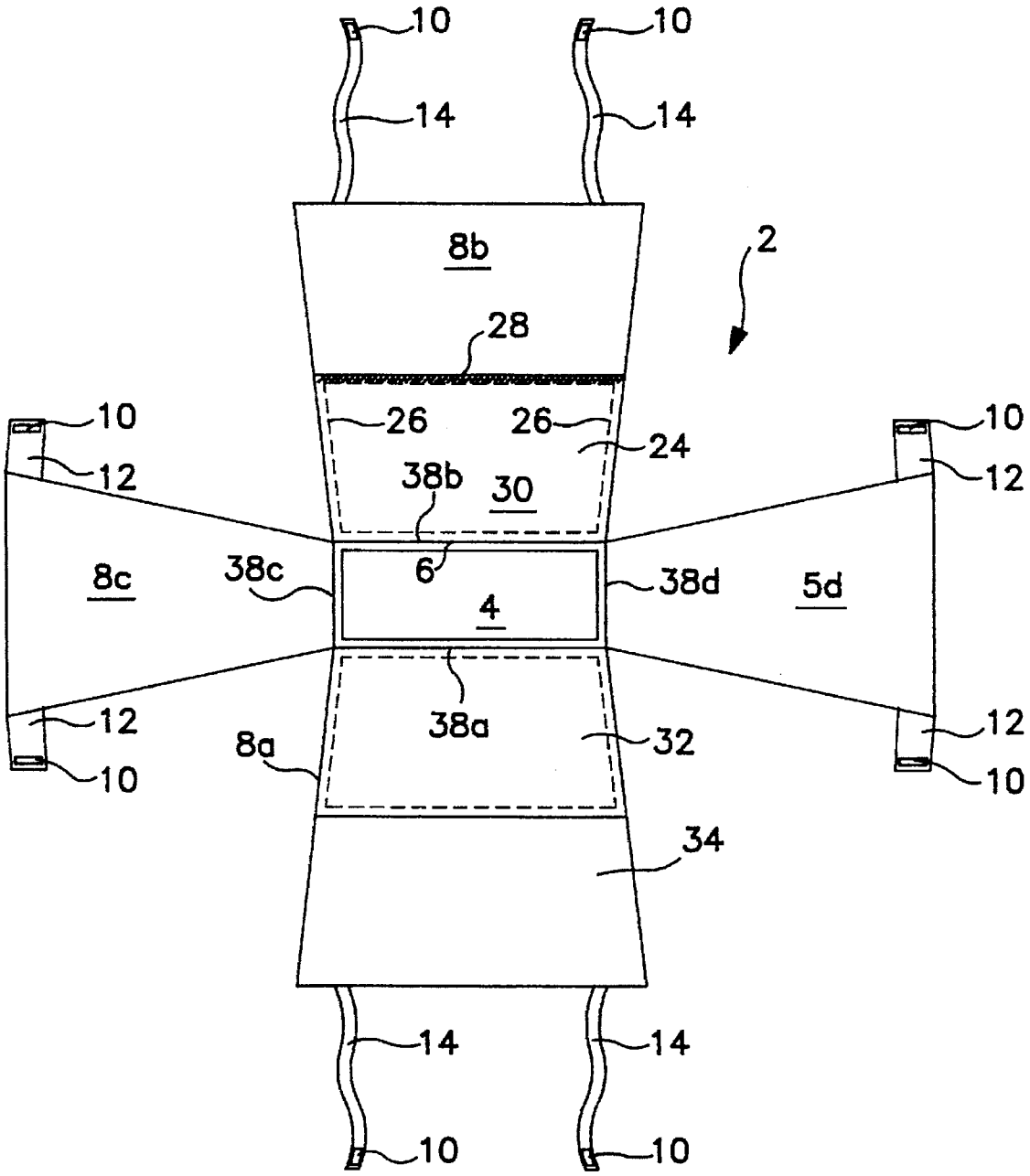
FIG. 3 is a plan view of the subject invention, unattached from the ladder and spread out on a single plane to better illustrate its many features.

Referring now to FIGS. 2 and 3, four side panels 8*a*, 8*b*, 8*c* and 8*d* are secured to, or integrally extend from, the sides of central panel 4, or alternatively from the sides of frame member 6. Each side panel is generally trapezoid shaped and hangs from central panel 4 to overlay the front, back and sides of the ladder. Commercial grade hook and loop strips or other fastening means 10 are employed to connect each panel with its neighboring panels and thus seal them together completing the "shell" of apron 2. With regard to the materials of construction, canvas or other such materials are preferred for their durability and washability and provide an article of manufacture that is simple and inexpensive to cut into the desired patterns for fabrication purposes.

To further secure apron 2 to the ladder, a plurality of closure flaps 12 and closure straps 14 are provided in strategic locations. Each flap 12 is designed to wrap around an individual leg of the ladder and be fastened, again with hook and loop tape or other conventional fastening means 10, to the interior wall of a particular side panel. As may be best observed in FIG. 2, for instance, closure flap 12*d* is wrapped around leg 16 of the ladder and is then removably fastened to the interior wall of side panel 8*d* using fastening means 10. Similarly, closure straps 14 may be observed wrapped around ladder rung 20 and step 22 and fastened to the interior walls of side panels 8*b* and 8*a*, respectively.

With the shell of apron 2 now described in detail, it is possible to appreciate some of its advantages over the prior art. First, closure straps 14 act to secure apron 2 to the ladder such that slippage of the apron either forward or backward is prevented. Closure flaps 12 prevent rotation of apron 2 about the ladder's vertical axis. Together, closure flaps 12 and straps 14 help conform apron 2 to the shape of the ladder whether it's legs are in the open position for use or closed for transport and storage. The subject apron will stay firmly attached to the ladder even when closed or turned upside down as ladders sometimes are during handling. The tight fit of apron 2 to nearly all conventional stepladders may be further ensured by utilizing elastic fabrics which can be stretched over the ladder's top and sides.

Another improvement of the subject invention over the prior art relates to its increased size and ability to accommodate more tools and accessories than heretofore possible. Referring once again to FIG. 1, it can be observed that a plurality of receptacles 36 of various shapes and sizes are provided to suit the needs of the particular type trades person. For instance, one pocket may be shaped to accommodate a power drill while others would be more suited for smaller hand tools. The receptacles may take the form of elastic pouches to better hold tools and accessories in place, particularly during transport and storage of the ladder, or may be manufactured of hard plastics, for instance, designed to store paint cans and the like. Hooks for hammers or other conventional tool holders found on utility belts may also be incorporated into the panels in a virtually unlimited number of combinations. It should be understood that the number, size and type of receptacles 36 employed may vary and the particular combination illustrated in the attached drawings is not intended to be limiting, it being appreciated that the intent of the inventor is to provide additional storage space generally, beyond that heretofore possible.

Formerly, ladder peripherals of the prior art extended, at most, from the top platform down to the first step. Making the peripheral any larger would interfere with the user's ability to use the top steps which would necessarily be covered. Yet, this area directly in front of the user was particularly accessible by the user's hands and offers an ideal location for additional tool and accessory storage. Moreover, if the rear side of the ladder were too large it would interfere with the fold-down shelf with which many stepladders are equipped for the placement of paint cans or other implements. The unique design of the subject invention takes advantage of these key storage areas without limiting access to the top steps or use of the rearward extending fold-down shelf.

To achieve use of rear panel 8*b* without interfering with the ability to use the ladder's fold-down shelf, shelf access means have been provided which preferably take the form of a door 24 provided in panel 8*b*. Door 24 is comprised of two vertical openings 26 connected at their bottoms to horizontal opening 28. Door 24 is thus capable of swinging about its top axis 30 to permit user access to the interior shelf which may be folded down for use without removal of apron 2. Door 24 is provided with closure means, again preferably of hook and loop tape or perhaps a zipper mechanism, etc. It may be appreciated that because stepladders are of relatively conventional measurement, the axis of rotation of the fold-down shelf, and therefore the precise location of its extension from the ladder itself, is highly predictable.

Accordingly, placement of door 24 within back panel 8*b* may effectively be accomplished.

Figure 4:
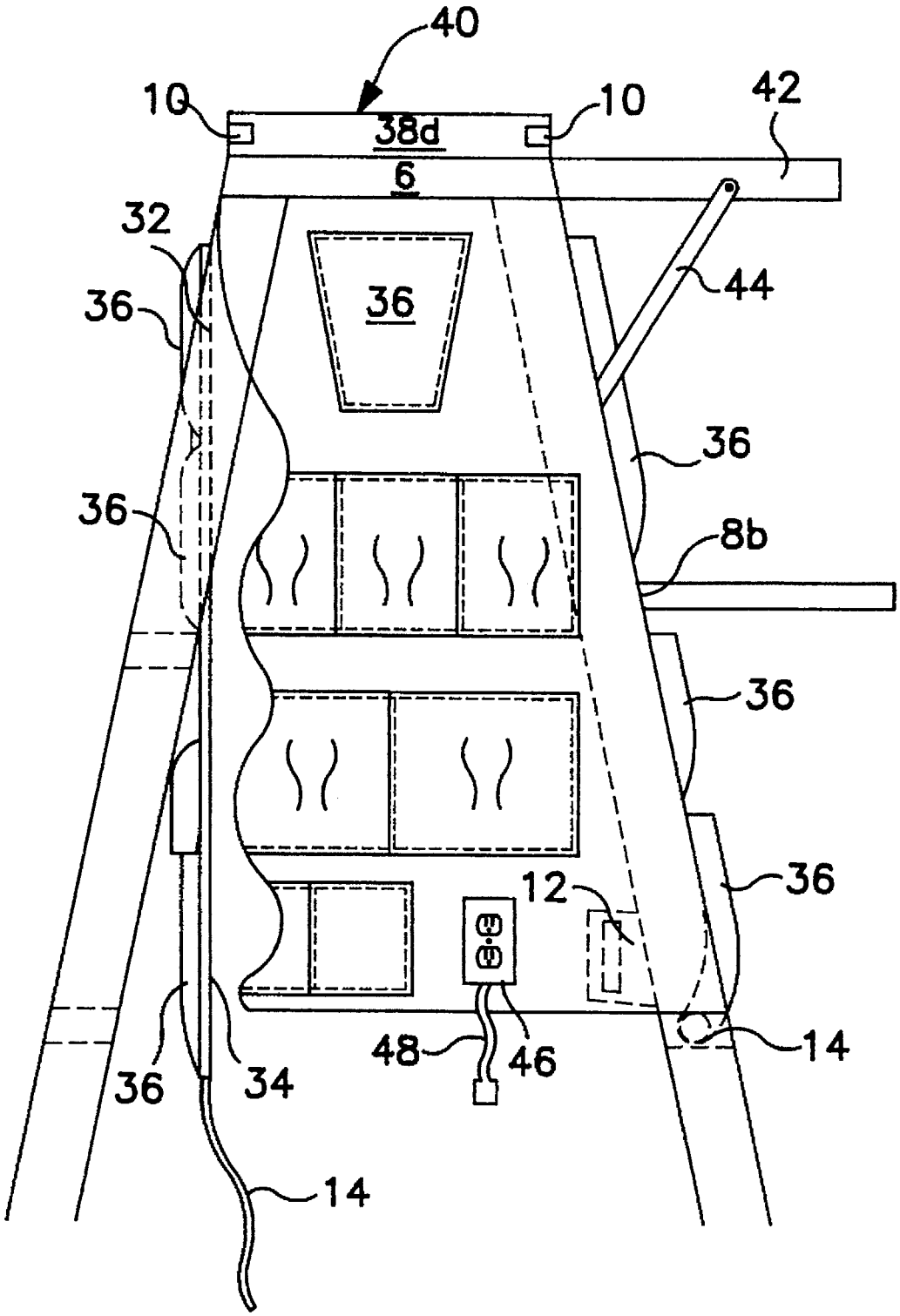
FIG. 4 is a side view of the subject invention with a side panel removed to illustrate the front panel in its suspended orientation under the ladder.
Figure 5:
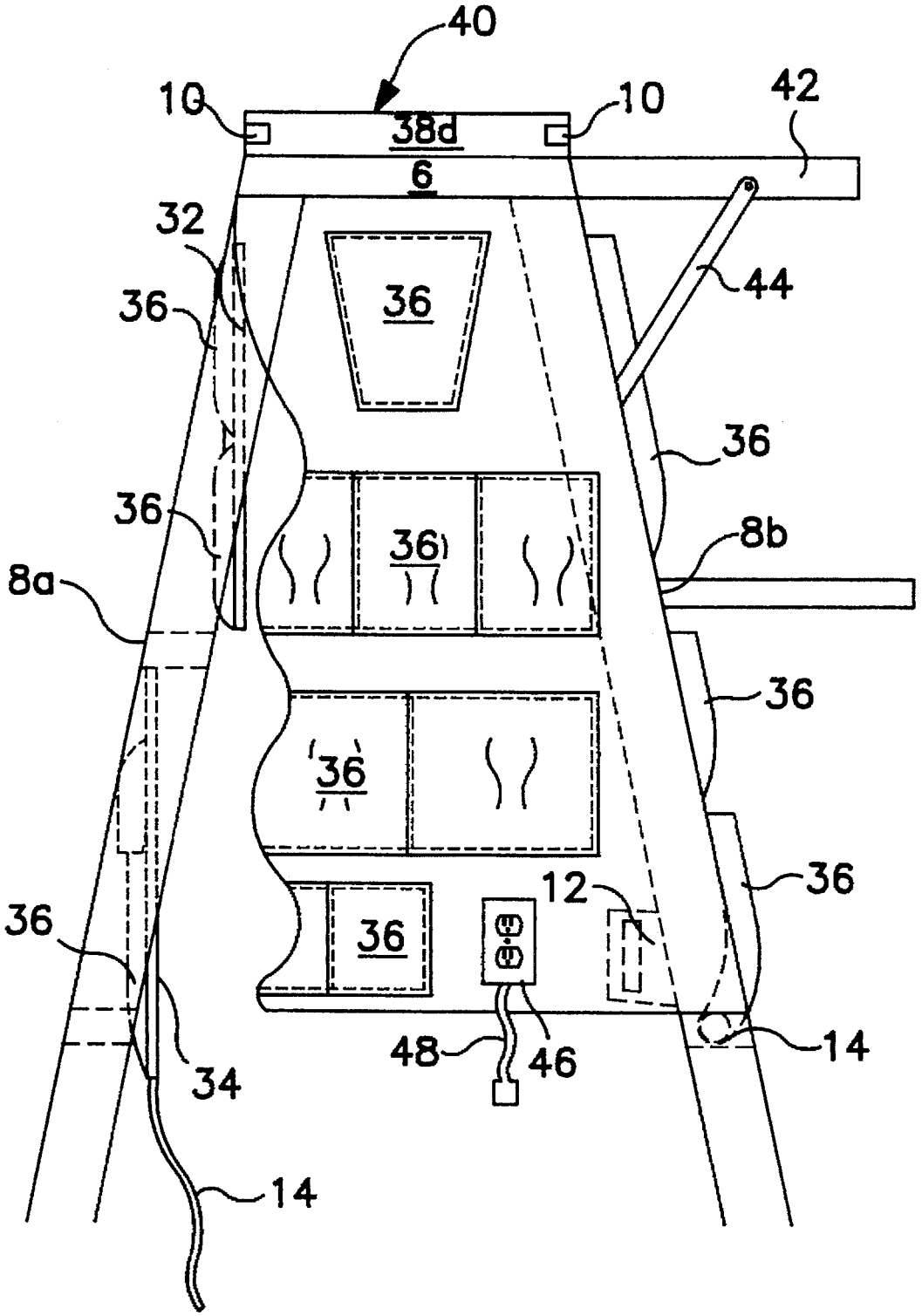
FIG. 5 is a side view of the invention of FIG. 4 depicting the use of step access doors.

In a similar fashion, access to the top few steps of the ladder is made possible, if desired, by either tucking panel 8*a* behind the steps such that it hangs vertically under the ladder (FIG. 4) or by tucking individual doors 32 and 34 behind the steps which they would otherwise cover such that together they hang vertically in a tiered manner (FIG. 5). It may be appreciated that the number of access doors to steps is limited only by the number of steps on the ladder and that, potentially, the front panel 8*a* of the subject invention could span the entire face of the ladder, although coverage of only the top two steps is generally preferred.

For those who use the top step of the stepladder as a shelf for tools and supplies, a set of four retaining walls 38*a*, 38*b*, 38*c* and 38*d* are pivotally attached to each side of the rectangular frame member 6 and fold up together to form a tray 40. Retaining walls 38*a–d* are connected to each other using fastening means 10 to form tray 40 which may be of varying depths, depending upon the height of each retaining wall. The retaining walls may be of rigid material to add strength, but are preferably of the same canvas material adapted to receive strips of semi-rigid plastic or the like which may be removed when it is desired to launder the entire apron 2. Tray 40 is particularly useful for those who have attempted to place screwdrivers, screws, nails or other objects pronged to rolling on the ladder's top shelf only to have them roll off. The retaining walls have been adapted to fold down to accommodate the user who may require use of the top shelf for other purposes besides storage.

An optional lid 42 may also be adapted to the frame member such that the lid pivots open to provide additional work space at the top of the ladder. Lid 42 is particularly useful for those ladders which do not have a fold-down shelf. It is contemplated that optional lid 42 will be constructed of rigid material sufficient to support heavy loads and will be removable. Folding support brackets 44 may also be provided to rest on the legs of the ladder or in separate holders (not shown) built into panel 8*b* of apron 2. The lid may also be of various depths providing an additional storage unit for accessories when closed. Conventional locks and handles may also be provided for security and to facilitate opening, respectively.

Finally, apron 2 may further be adapted with a power receptacle 46 removably attached to one of the side panels 8*a–d*. A ponytail 48 is fixedly attached to receptacle 46 to receive a power extension cord. Once connected, the user may have immediate access to one or more power tools or other electrical appliances such as lighting. Power tools can thereby be easily interchanged without disengaging the extension cord for each particular tool.

Although the present invention has been described with reference to the particular embodiments herein set forth, it is understood that the present disclosure has been made only by way of example and that numerous changes in details of construction may be resorted to without departing from the spirit and scope of the invention. Thus, the scope of the invention should not be limited by the foregoing specification, but rather only by the scope of the claims appended hereto.

What is claimed is:

1. A multi-purpose utility apron for use with a step ladder having front legs connected by steps, back legs connected by rungs, and a top platform, the apron comprising:

a) a central panel capable of being positioned over the top platform of the ladder;

b) a front panel connected to said central panel; said central panel adapted to cover at least one step of the ladder;

c) a rear panel connected to said central panel; said rear panel adapted to cover at least one rung of the ladder;

d) a first side panel connected to said central panel; said first side panel adapted to cover at least a portion of one front leg and one back leg of the ladder;

e) a second side panel connected to said central panel; said second panel adapted to cover at least a portion of the other front leg and other back leg of the ladder;

f) a plurality of receptacles attached to each of said front, rear and side panels for the retention of tools and accessories; and g) a collapsible tray attached to said central panel; said tray comprised of four retaining walls each pivotally attached to a different side of said central panel such that when folded up, said retaining walls form said tray and when folded down, said retaining walls hang freely to permit use of the ladder's platform in the conventional manner.

2. The invention of claim 1, wherein said rear panel is adapted with access means to permit access to and use of a fold-down shelf attached to the ladder's back legs without limiting the number or size of said plurality of receptacles attached to said rear panel.

3. The invention of claim 1, wherein said front panel is adapted with at least one access means capable of permiting access to the steps of the ladder which said front panel covers without limiting the number or size of said plurality of receptacles attached to said front panel.

4. A multi-purpose utility apron for use with a step ladder having front legs connected by steps, back legs connected by rungs, and a top platform, the apron comprising:

a) a central panel capable of being positioned over the top platform of the ladder;

b) a front panel connected to said central panel; said central panel adapted to cover at least one step of the ladder;

c) a rear panel connected to said central panel; said rear panel adapted to cover at least one rung of the ladder;

d) a first side panel connected to said central panel; said first side panel adapted to cover at least a portion of one front leg and one back leg of the ladder;

e) a second side panel connected to said central panel; said second panel adapted to cover at least a portion of the other front leg and other back leg of the ladder;

f) a plurality of receptacles attached to each of said front, rear and side panels for the retention of tools and accessories; and g) a lid pivotally attached to one side of said central panel such that when opened, said lid lies in coplaner relationship to the platform of the ladder thereby providing additional work space and when closed, said lid provides a step or work area under which tools and other accessories may be stored.

5. The invention of claim 4, wherein said rear panel is adapted with access means to permit access to and use of a fold-down shelf attached to the ladder's back legs without limiting the number or size of said plurality of receptacles attached to said rear panel.

6. The invention of claim 4, wherein said front panel is adapted with at least one access means capable of permiting access to the steps of the ladder which said front panel covers without limiting the number or size of said plurality of receptacles attached to said front panel.

* * * * *